United States Patent [19]

Huang

[11] Patent Number: 5,044,591

[45] Date of Patent: Sep. 3, 1991

[54] DEVICE FOR MOUNTING TOOL HAVING TWO PIVOTED HANDLES

[76] Inventor: Te-Chen Huang, No. 12, South 3rd Alley, Yung Hsin Lane, Wen Hua Rd., HsiTun Area, Taichung, Taiwan

[21] Appl. No.: 644,816

[22] Filed: Jan. 23, 1991

[51] Int. Cl.[5] ..... A47F 5/00

[52] U.S. Cl. ..... 248/317; 248/316.5; 211/70.6

[58] Field of Search ..... 248/317, 316.5, 340, 248/683, 214; 211/70.6; 30/231

[56] References Cited

U.S. PATENT DOCUMENTS

| | | | |
|---|---|---|---|
| 1,822,070 | 9/1931 | Vallone | 211/70.6 X |
| 2,649,191 | 8/1953 | McLaughlin | 211/70.6 X |
| 4,043,754 | 8/1977 | Sklar | 211/70.6 X |
| 4,634,005 | 1/1987 | Kulzer et al. | 211/70.6 X |
| 4,830,247 | 5/1989 | Banks | 211/70.6 X |

*Primary Examiner*—Alvin C. Chin-Shue

*Attorney, Agent, or Firm*—Varndell Legal Group

[57] ABSTRACT

For mounting a hand tool having two pivoted handles, a device comprising a hole for hanging on a wall surface, a means for hanging on one's waist belt, a plurality of through-holes for fastening a binding wire to secure the two jaws of the hand tool mounted thereon, a support at one end, a cover plate pivoted to said support defining therewith two mounting holes for holding the two pivoted handles of said handle tool. A hook member is made on the support to hook up with the hook member, which is made on the cover plate at one end, when the cover plate is closed up.

3 Claims, 2 Drawing Sheets

DEVICE FOR MOUNTING TOOL HAVING TWO PIVOTED HANDLES

BACKGROUND OF THE INVENTION

The present invention relates to a hand tool mounting device and more particularly to a device for mounting a hand tool having two pivoted handles, permitting a hand tool to be conveniently carried with oneself or hung on a wall surface for show.

A small hand tool must be properly packed before it is sent to an outlet for sale. It has been now the most common way to individually pack a hand tool in a transparent plastic covering on a paper or plastic card which generally has a hole for hanging on a nail or a projecting object from a wall surface so that the hand tool packed therein can be conveniently carried with oneself or hung on wall surface for show. This packing method is not satisfactory in use because it produces some disadvantages as outlined hereinafter.

1. Because the plastic covering or card must be discarded when the hand tool is to be used, environmental pollution problem can not be eliminated.

2. Because the plastic covering is not openable before purchase, a consumer can only examine the hand tool packed therein through visual examination.

3. After the plastic covering is removed, a separate hand tool case or mounting device may be required to hold or carry the hand tool.

SUMMARY OF THE INVENTION

The present invention has been accomplished to eliminate the aforesaid problems. It is therefore an object of the present invention to provide a hand tool mounting device which is specifically designed for mounting a hand tool having two pivoted handles.

It is still another object of the present invention to provide a hand tool mounting device which is convenient in use for holding a hand tool for show.

It is another object of the present invention to provide a hand tool mounting device which is convenient in use for carrying a hand tool with oneself.

It is still another object of the present invention to provide a hand tool mounting device which is convenient in use for holding different size of hand tool.

It is still another object of the present invention to provide a hand tool mounting device which does not cause environmental pollution.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
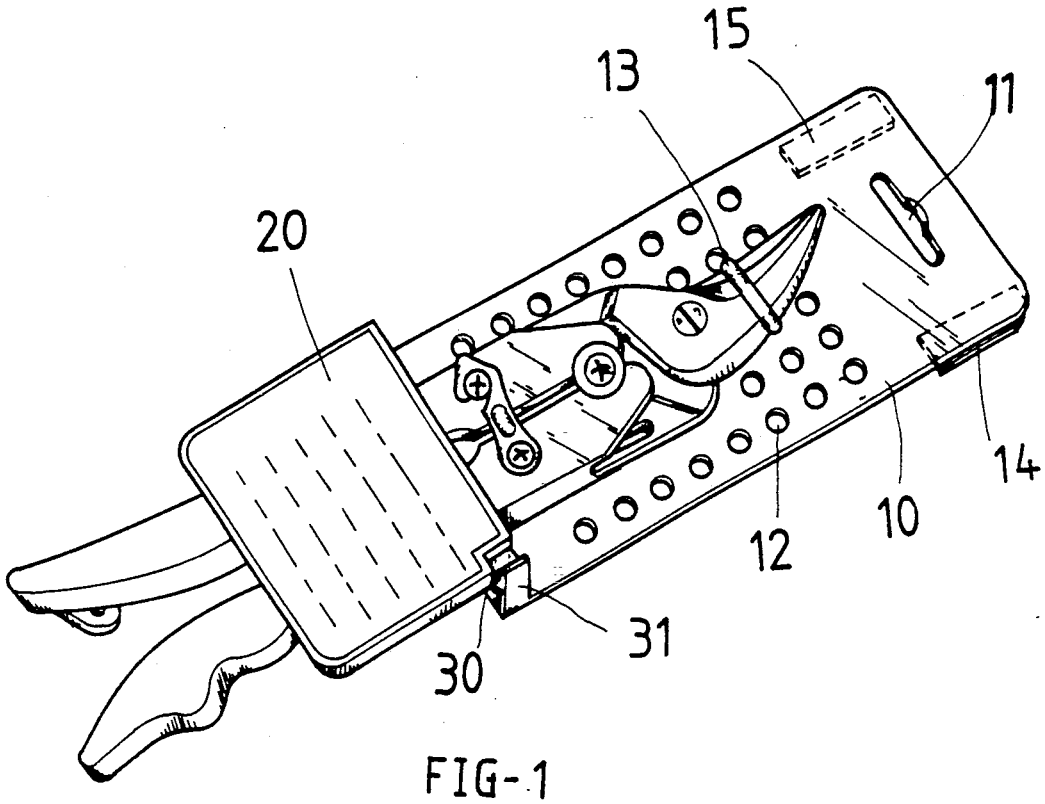
FIG. 1 illustrates the preferred embodiment of the present invention in which a pliers is fastened in position.
Figure 2:
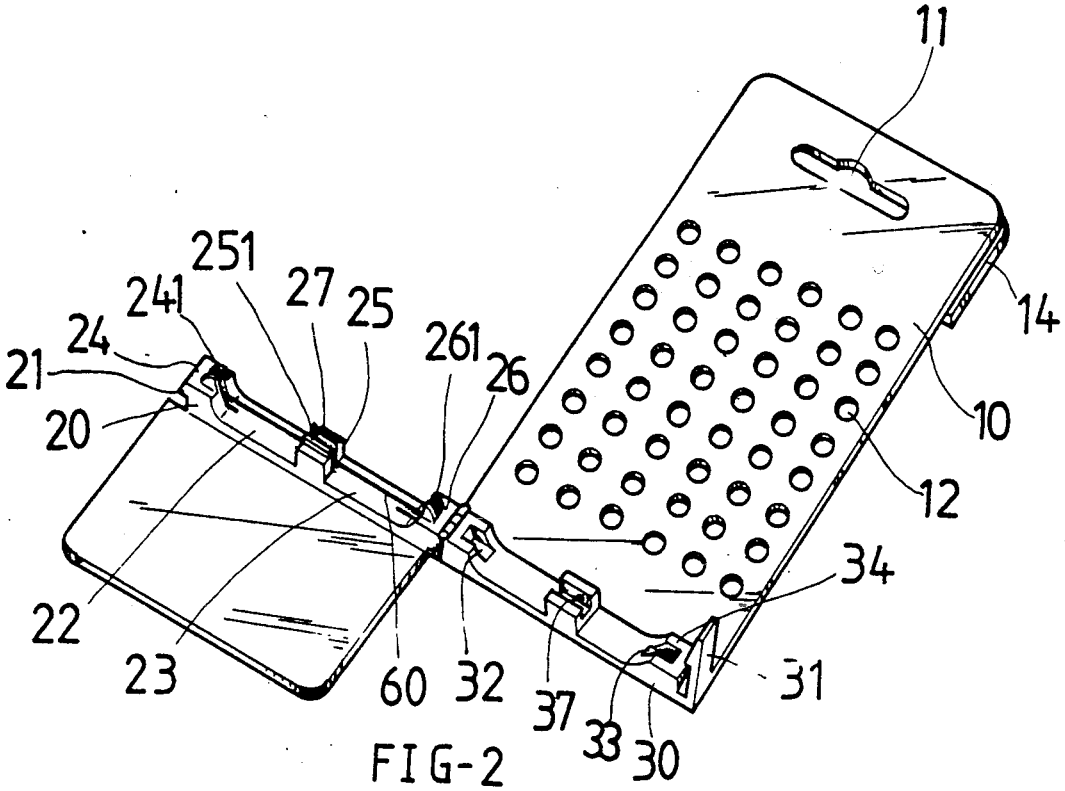
FIG. 2 is a perspective view of the preferred embodiment of the present invention in which the cover plate is disposed in an opened condition.

Referring to FIGS. 1 and 2, therein illustrated is the preferred embodiment of the present invention which is generally comprised of a flat board 10 made from flexible rubber or plastic material, having a hanging hole 11 at one end, a support 30 transversely disposed at an opposite end, and a plurality of small through-holes 12 arranged therebetween and longitudinally latitudinally aligned. Through the through-holes 12, a binding wire 13 may be fastened to secure the two jaws of a pincers to the flat board 10 at one side. The flat board 10 further comprises a pair of L-shaped strips 14 and 15 bilaterally made at one end on the opposite side thereof. By means of the L-shaped strips 14 and 15, the present invention can be conveniently hanging on one's waist belt. There is provided a cover plate 20 pivoted to the support 30 by a hinge 40 at one end (see FIG. 3). By means of the hinge 40, the cover plate 20 can be conveniently opened from or closed onto the support 30. The support 30 is made from resilient plastic material, having a unitary hook member 31 at one end opposite to the connecting end to which the cover plate 20 is pivoted. The cover plate 20 has a front face on which specification, instruction, mark or any desired logo can be printed or marked, a unitary hook member 21 at an end opposite to the end which is pivoted to the support 30. By means of hooking up the member 21 of the cover plate 20 with the hook member 31 of the support 30, the cover plate is firmly retained in a closed position covering over the support 30. By means of the resilient material property of the support 30, the hook member 31 of the support 30 can be conveniently bent outwards to disengage from the hook member 21 of the cover plate 20 permitting the cover plate 20 to be opened from the support 30.

The cover plate 20 has three blocks 24, 25 and 26 spaced from one another at equal interval and transversely aligned, wherein the blocks 24 and 25 defined therebetween a substantially semi-oval notch 22 and the blocks 25 and 26 define therebetween another substantially semi-oval notch 23. Similar to the cover plate 20, the support 30 has three blocks 34, 35 and 36 spaced from one another at equal interval and transversely aligned wherein the blocks 34 and 35 define therebetween a substantially semi-oval notch 32 and the blocks 35 and 36 define therebetween another substantially semi-oval notch 33. The blocks 24, 25 and 26 of the cover plate 20 have each a ridge portion 27 corresponding to the recessed hole 37 on each of the blocks 34, 35 and 36 of the support 30. When the cover plate 20 is closed on the support 30 of the flat board 10, the hook members 21 and 31 are engaged together, the ridge portions 27 of the blocks 24, 25 and 26 are respectively fastened in the recessed holes 37 of the blocks 34, 35 and 36, and the semi-oval notches 22 and 23 respectively incorporated with the semi-oval notches 32 and 33 into two oval holes for mounting the two pivoted handles of the hand tool fastened in the flat board 10. The semi-oval notches 22, 23 and 32, and 33 shall be made as big as possible so that bigger hand tool can be conveniently fastened in the device. However, certain measure must be taken if a small hand tool is to be fastened in the device. According to the present invention, an opening 241, 251 or 261 is made on each of the blocks 24, 25 and 26 for fastening a spring wire 60 which can firmly retain the two pivoted handles fastened in the two oval holes of the semi-oval notches 22, 23 and 32, 33.

Figure 3:
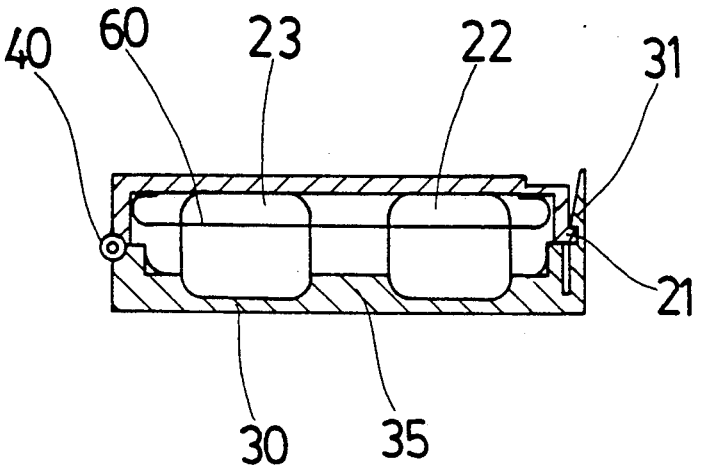
FIG. 3 is a sectional end view of the preferred embodiment of the present invention in which the cover plate is disposed in a closed condition.
Figure 4:
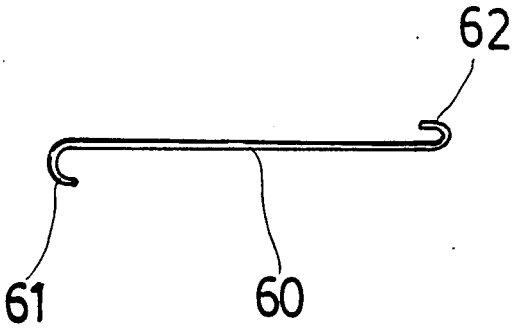
FIG. 4 illustrates the spring wire of the preferred embodiment of the present invention.

Referring to FIG. 3, after the cover plate 20 is closed to the support 30 with the hook members 21 and 31 firmly hooked together, the spring wire 60 is transversely extending into the semi-oval notches 22 and 23 at a certain range so as to flexibly press on the two pivoted handles of the hand tool fastened therein. The spring wire 60 has two hooked opposite ends 61 and 62 disposed at two opposite sides. After the spring wire 60 is fastened in the openings 241, 251 and 261, it is twisted so that the hooked end 61 is turned to longitudinally aligned with the hooked end 62 (as shown in FIG. 3). Because the spring wire 60 is twisted, it becomes firmly retaied inside the openings 241, 251 and 261.

As illustrated, by means of the hanging hole 11, the device can be hung on a nail or any projecting object extending from a wall surface for show; by means of the L-shaped strips 14 and 15, the device can be hung on one's waist belt; by means of the effect of the spring wire 60, a hand tool of different size can be firmly retained in position when it is mounted on the device.

I claim:

1. For mounting a hand tool having two pivoted handles, a device comprising:

a flat board made from flexible rubber or plastic material, having a hanging hole at one end, a plurality of small through-holes longitudinally latitudinally aligned, and a pair of L-shaped strips bilaterally disposed on an opposite side by said hanging hole;

a support transversely made on said flat board at on end opposite to said hanging hole, having three blocks spaced from one another at equal interval with two openings defined therebetween and a hook member made from resilient material at one end thereof;

a cover plate pivoted to said support by a hinge means at one end of said cover plate, having three blocks spaced from another at equal interval with two openings defined therebetween, and a hook member at another end;

wherein said cover plate is closed to said support with the hook member thereof hooked with the hook member of said support, with the two openings thereof incorporated with the two openings of said support into two holes for mounting the two pivoted handles of said hand tool.

2. The device of claim 1, wherein the three blocks of said cover plate have each a ridge portion respectively fastened in a recessed hole on each of the three blocks of said support.

3. The device of claim 1, wherein the three blocks of said cover plate have each a recessed hole longitudinally aligned with one another for fastening spring wire to firmly retain the two pivoted handles of said hand tool in position.

* * * * *